United States Patent [19]

Brothers

[11] 4,125,939

[45] Nov. 21, 1978

[54] RAZOR BLADE ARRANGEMENT

[76] Inventor: Abe R. Brothers, 3215 Ave. H, Brooklyn, N.Y. 11210

[21] Appl. No.: 803,654

[22] Filed: Jun. 6, 1977

[51] Int. Cl.[2] ..... B26B 21/22

[52] U.S. Cl. ..... 30/50

[58] Field of Search ..... 30/346.57, 346.58, 346.59, 30/50

[56] References Cited

U.S. PATENT DOCUMENTS

| | | | |
|---|---|---|---|
| 3,262,206 | 7/1966 | Tomek | 30/346.59 |
| 3,858,315 | 1/1975 | Ferraro | 30/346.58 |

FOREIGN PATENT DOCUMENTS

| | | | |
|---|---|---|---|
| 321,757 | 6/1920 | Fed. Rep. of Germany | 30/5 |
| 516,445 | 12/1920 | France | 30/50 |

*Primary Examiner*—Jimmy C. Peters

*Attorney, Agent, or Firm*—Lackenbach, Lilling & Siegel

[57] ABSTRACT

A razor blade arrangement is described, which includes first and second generally planar razor blades each having a longitudinal extending cutting edge. A spacer element is provided which is adapted to be disposed between the razor blades and is configurated and dimensioned to offset the relative orientations of the cutting edges to each other and to space the cutting edges from each other in directions substantially normal and parallel to the planes of the razor blades to place the cutting edges in extreme proximity to each other while maintaining the blade portions near the cutting edges in uniform pressure abutment immediately adjacent to the longitudinal cutting edges when the razor blades and the insert element are placed in a safety razor. The insert element further maintains the razor blades in generally parallel longitudinal relation during use.

13 Claims, 8 Drawing Figures

FIG. 5
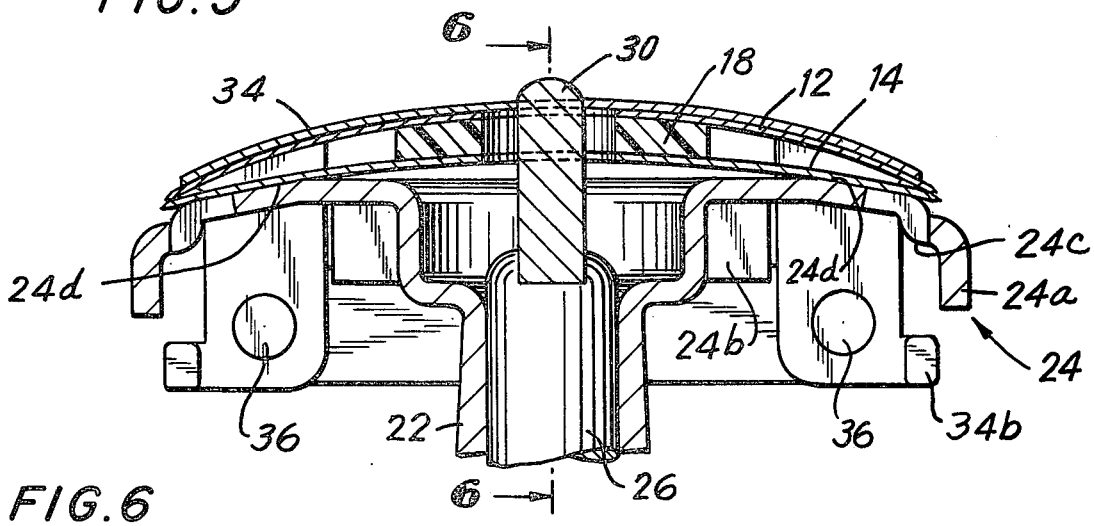
FIG. 6
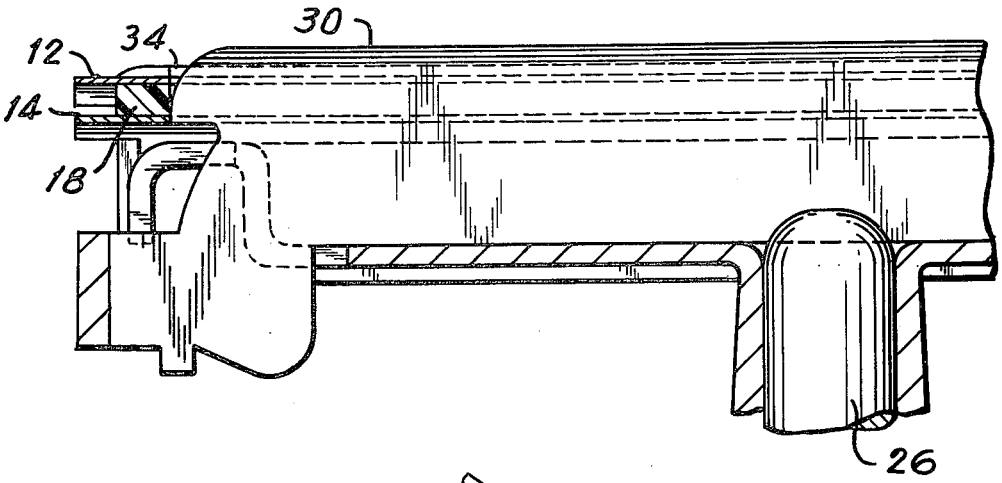
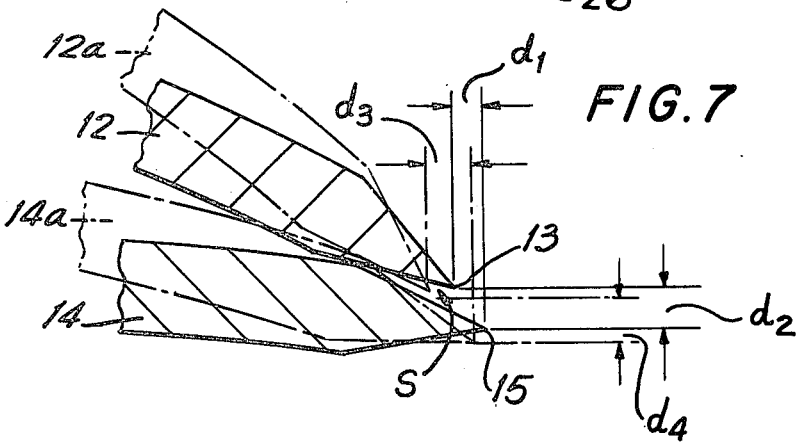
FIG. 7
FIG. 8
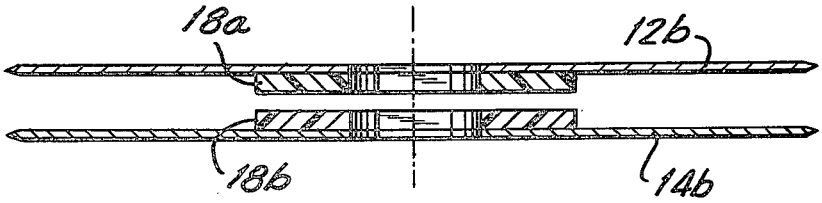

RAZOR BLADE ARRANGEMENT

BACKGROUND OF THE INVENTION

This invention generally relates to shaving devices, and more specifically to a razor blade arrangement which includes two razor blades whose general spacing and relative positions or orientations within a safety razor are modified by a spacer element disposed between the two razor blades.

Numerous shaving devices are known in the prior art. The general aim or goal of all of these devices is to provide a better shave for the user, a shave which is closer while minimizing the risks of injury or damage to the skin of the user. For this purpose, numerous safety razor blade devices have been proposed, such as the safety razor blade described in U.S. Pat. No. 2,637,905.

Additionally, the use of spacers in conjunction with single or double blade arrangements is also known. When used with single blades, the inserts are normally intended to support the blade at its cutting edge even though located at varying distances from the guard. Such inserts are additionally intended to stabilize the cutting edge when in use. Typical of single blade arrangements using inserts are described in U.S. Pat. No. 2,313;818 and German Pat. No. 803,281.

With respect to the double razor blade arrangements, these have typically been used to provide a double cutting action which is simultaneous in time so as to make shaving more efficient. The double blade razors frequently have the goal of first engaging the hair to be cut with one blade and cutting it with the other blade. Other known razor blade arrangements of the double blade type have been promoted as providing quick shaves with relatively low blade pressure against the skin and without skin irritation or damage. However, with the prior art double edge arrangements, the blades are normally maintained in spaced relation during use, there being no contact between the two spaced blades. In fact, in some prior art devices, the cutting edges of the adjacent blades have been substantially spaced from each other. Another characteristic inherent in most of the prior art devices is that the blades have been maintained parallel to each other over their coextensive surfaces, and including in the region of the longitudinal cutting edges. Accordingly, the cutting edges of both cooperating or associated blades have generally provided a uniform or substantially equal angle of attack with respect to the hair to be cut. Typical of the two-blade arrangements which have utilized inserts include the following patents: U.S. Pat. Nos. 2,319,980; 1,911,378; 3,262,206; 2,794,252 and German Pat. No. 853,397.

In none of the prior art devices which utilize two razor blades, are the razor blades flexed at different radii of curvature by a spacer therebetween in order that the cutting edges are maintained in longitudinal pressure abutment against each other when the razor blades and the insert element are placed in a safety razor. Additionally, the prior arrangements do not contemplate a spacer element which is configurated and dimensioned to offset the relative orientations of the cutting edges to each other and the transverse positions thereof.

More recent approaches have used two razor blades having different widths, as shown in FIG. 2 of this application. The two razor blades are positioned adjacently to each other as shown and spot welded. The widths of the two cooperating blades are such as to provide a distance or spacing D between the adjacent cutting edges. However, as is evident from FIG. 3, the prior art approach prevents relative movements between the adjacent cutting edges, so that even when the blade arrangement is placed in a safety razor and the blades are simultaneously flexed, the distance or spacing between the cutting edges remains at the preselected value D.

Most recently, injection as well as cartridge razor blade arrangements have been proposed and sold commercially. Many of these arrangements utilize two single edge blades which are spaced to each other. However, as with the prior art shaving devices described above, the blades are maintained substantially parallel over their entire surface areas and the cutting edges are not placed in contact with each other or in pressure abutment against each other. These newer arrangements have additionally relied upon substantially parallel cutting edges which have not provided the flexibility or adjustability required to provide a comfortable close shave under varying shaving conditions or personalized to the individual beard of the user.

A shaving arrangement has even been proposed which utilizes a plurality of razor blades, five being disclosed in French Pat. No. 684,234. As with the prior art devices described above, the spacer elements between adjacent blades merely space the blades from each other but does not effect a modification in the radii of curvature of adjacent blades so as to place the cutting edges in proximity to each other, and advantageously, into pressure abutment against each other while offsetting the transverse distances between the cutting edges and the relative angular orientations therebetween.

SUMMARY OF THE INVENTION

Accordingly, it is an object of the present invention to provide a razor blade arrangement which overcomes the above-described disadvantages associated with prior art comparable constructions.

It is another object of the present invention to provide a razor blade arrangement which is simple in construction and economical to manufacture.

It is still another object of the present invention to provide a razor blade arrangement which provides a more comfortable shave and which may utilize either single edge or double edge blades.

It is yet another object of the present invention to provide a razor blade arrangement which utilizes a spacer adapted to be placed between two razor blades, which spacer may be modified in its configuration or dimensions to adjust or change the general positions and orientations of the cutting edges of the razor blades.

It is a further object of the present invention to provide a razor blade arrangement which includes a spacer adapted to be arranged between two adjacent razor blades, which spacer modifies the radii of curvature of the two razor blades so as to ensure that the cutting edges are in extreme proximity and the blade portions near the cutting edges are in uniform pressure abutment immediately adjacent to the longitudinal cutting edges.

It is still a further object of the present invention to provide a razor blade arrangement which may be utilized in conventional safety razors.

It is yet a further object of the present invention to provide a safety razor arrangement which provides a more comfortable shave utilizing two identically shaped and dimensioned razor blades.

It is an additional object of the present invention to provide a razor blade arrangement which may utilize razor blades to which are attached or integrally formed spacer elements which are dimensioned and configurated to provide the desired curvature in the associated blades and provide the desired relative spacing between the cutting edges in the directions substantially normal and parallel to the planes of the razor blades, as well as the angular orientations of the cutting edges during use.

In order to achieve the above objects, as well as others which will become evident from the description that follows, a razor blade arrangement in accordance with the present invention includes first and second generally planar razor blades each having longitudinally extending cutting edges. A spacer element is provided which is adapted to be disposed between the razor blades and configurated and dimensioned to offset the relative orientations of the cutting edges to each other and to space the cutting edges from each other in directions substantially normal and parallel to the planes of the razor blades to place the cutting edges in extreme proximity to each other while maintaining the blade portions near the cutting edges in uniform pressure abutment immediately adjacent to the longitudinal cutting edges when said razor blades and said insert elements are placed in a safety razor. Said insert element further maintains said razor blades in generally parallel longitudinal relation during use.

By modifying the dimensions of the insert element, the radii of curvature of the adjacent razor blades can be changed, as well as the offset in the spacing or positions of the cutting edges as well as the relative angular orientations therebetween may be changed to provide a smoother and more comfortable shave.

The present invention also contemplates the combination of the razor blade arrangement above-described with a safety razor having a relatively fixed guard element and at least one generally arcuate bending or clamping plate adjustably positionable with respect to said fixed guard element. With such an arrangement, clamping said razor blade arrangement between said guard element and said bending or clamping plate causes said first razor blade proximate to said bending or clamping plate to assume a radius of curvature smaller than that of said second razor blade proximate to said guard to thereby offset the angular orientations as well as the transverse positions of said cutting edges.

BRIEF DESCRIPTION OF THE DRAWINGS

Further advantages of the invention will become apparent from a reading of the following specification describing illustrative embodiments of the invention. The specification is to be taken with the accompanying drawings, in which:

FIG. 5 is an enlarged cross-sectional view taken substantially along lines 5—5 of FIG. 4;

FIG. 6 is a fragmented cross-sectional view taken substantially along line 6—6 of FIG. 5;

FIG. 7 is an enlarged cross-sectional view of the cutting edges of the razor blades showing the adjustable gap that is created by varying the thickness of the spacer element; and FIG. 8 is a cross-sectional view of an alternate embodiment which includes two blades fabricated with a spacer element adhered thereto or integral therewith.

DESCRIPTION OF THE PREFERRED EMBODIMENTS

Figure 1:
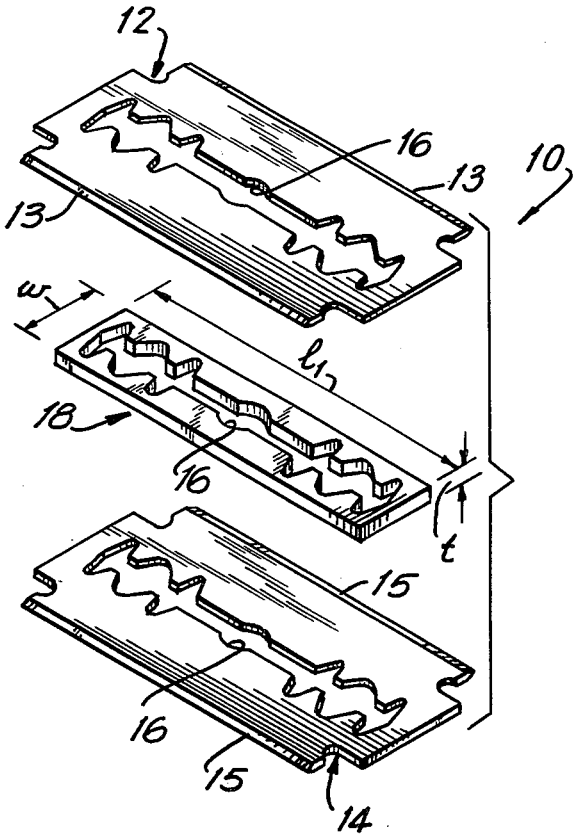
FIG. 1 is an exploded perspective view showing two conventional double edged razor blades with the spacer element positioned therebetween in accordance with the present invention.

Referring now specifically to the drawings, in which identical or similar parts are designated by the same reference numerals throughout, and first referring to FIG. 1, the razor blade arrangement in accordance with the present invention is generally designated by the reference numeral 10.

The razor blade arrangement 10 includes an upper or first double edge razor blade 12 having at least one cutting edge 13 and a lower or second double edge razor blade 14 having at least one cutting edge 15. The two razor blades 12, 14 are conventional and are shown to be provided with cut-outs 16. The razor blades 12, 14 are generally planar or flat as shown and are both identical or substantially similar in shape and configuration. While double edge razor blades 12, 14 are shown, it will become evident to a person skilled in the art, from the description that follows, that the same invention may be practiced equally effectively with single edge razor blades.

An important feature of the present invention is the provision of a spacer element 18, shown in FIG. 1 to be generally rectangular, which, when used with razor blades of the type illustrated, is provided with a cut-out 16 which is similarly configurated and dimensioned to the cut-outs 16 in the razor blades, so that alignment of the razor blades and the spacer element simultaneously aligns or superimposes the cut-out 16 and places the same in registry for receiving lugs or other spacer or positioning members provided on the safety razor.

As shown, the spacing member 18 has a transverse width W, a longitudinal length L and a thickness T. The dimensions of the spacer element 18 will be more fully discussed below.

Figure 4:
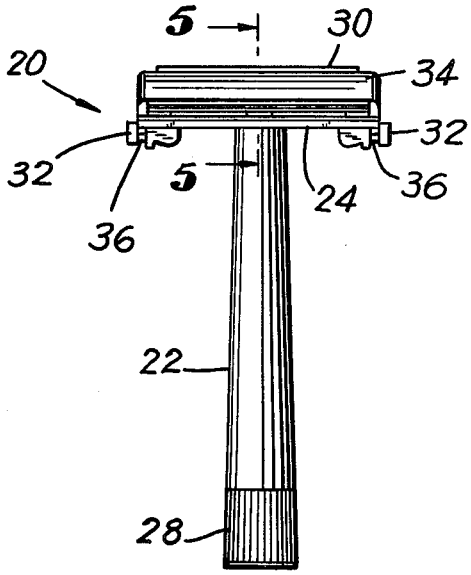
FIG. 4 is a side elevational view of a conventional razor fitted with the double blade arrangement or combination of this invention.

The razor blade arrangement 10 of the present invention may be utilized with conventional safety razors. Referring to FIGS. 4–6, a typical safety razor 20 is shown which includes a handle 22 which is rigidly or fixedly connected to a guard element or member 24. The handle 22 is hollow and houses a plunger 26 which can slidably move along the length of the handle 22 in response to rotation of rotatable member 28 in a conventional manner.

Fixedly connected to the top or free end of the plunger 26 is a longitudinal locating or positioning bar 30 which is adapted to be received within the cut-outs 16 of the razor blades. Rigidly or fixedly connected to the longitudinal ends of the locating bar 30 are a pair of spaced or opposed transverse arms 32 which share the axial movements of the plunger 26 and locating bar 30 with rotation of the member 28.

As best shown in FIG. 5, a pair of bending or clamping plates 34 are pivotally mounted on the transverse arms 32 by means of pins 36. However, the bending or clamping plates 34 are normally prevented from freely turning on the pins 36 by the guard member 24, which includes a downwardly directed rim or edge 24*a* and a downwardly directed tab 24*b* which together form a panel or guide for the portions 34*a* of the plates 34. The plate portions 34*a* are provided at their lower ends, as viewed in FIG. 5, with laterally extending portions 34*b* which is arranged to engage in abutment surface portion 34*c* of the guard 24 only when the plunger 26 has reached its almost fully extended position, engagement between the portion 34*b* and the abutment portion or surface 24*c* causing the bending or clamping plates 34 to pivot about the pins 36 and open to expose the razor blades in a well known manner.

When the plunger 26 is retracted, the clamping plate 34 is urged towards and against the guard 24, which is advantageously provided with two surface portions 24*d* which are inclined with respect to a surface normal to the plunger 26. In this manner, urging the clamping plates 34 against the guard 24 causes the lowermost or second razor blade 14 to assume an acruate condition with a predetermined radius of curvature.

By selecting a suitable configuration and dimensions of the spacer element 18, the orientations of the cutting edges 13, 15 are offset relative to each other. Additionally, referring to FIG. 7, the cutting edges 13, 15 are shown to be offset or spaced from each other in directions substantially parallel and normal to the planes of the razor blades 12, 14 distances $d_1$, $d_2$ respectively. As will also be noted from these Figures, the cutting edges 13, 15 are maintained very close or proximate to each other, and in the preferred embodiments, the cutting edges are in contact or in pressure abutment immediately adjacent to the longitudinal cutting edges 13, 15 as best shown in FIG. 7 and form a space S having a generally triangular cross-section. In the last mentioned Figure, the cutting edges shown in dashed outline represent the razor blades 12 and 14 with one spacer element therebetween to provide transverse offsets of the cutting edges $d_1$ and $d_2$. When another spacer element 18, with different configuration or dimensions is used, it will be noted that the razor blades assume new positions 12*a* and 14*a* to modify the relative angular orientations of the cutting edges as well as the offsets therebetween, now exhibiting corresponding offsets $d_3$ and $d_3$. This feature of the present invention, wherein both adjacent cutting edges cut simultaneously, allows the relative angular orientations as well as the transverse offset to be modified and thereby permit the razor arrangement 10 to be customized to the particular user in order to take into consideration or compensate for the user's special beard or skin conditions.

Figure 2:
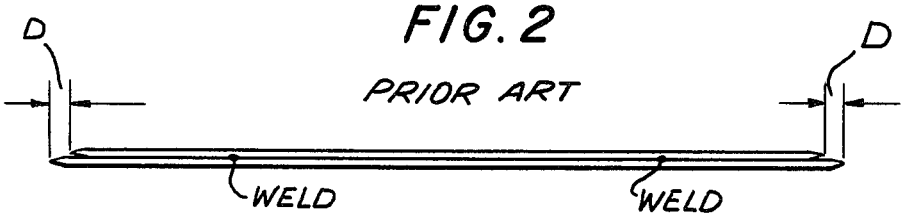
FIG. 2 PRIOR ART
FIG. 2 is a side elevational view of a twin double edged blade of the prior art.
Figure 3:
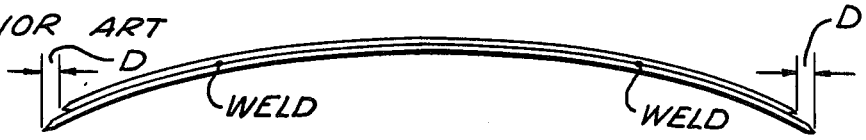
FIG. 3 PRIOR ART
FIG. 3 is a view of the combination blade of FIG. 2 in the curved position (as it would appear in use in a conventional razor) so as to illustrate the fact that the edges of the blades are set at a fixed distance so that there is no relative movement between the flat and curved portions.

This adjustability feature is obviously not possible with the prior art arrangements shown in FIGS. 2 and 3, wherein two differently sized blades are spot welded together and the transverse distance remains fixed independently of whether the blades are flat or flexed within the safety razor.

Referring to FIG. 8, the razor blade arrangement of the present invention may also be achieved by attaching spacer member portions 18*a* and 18*b* to respective razor blades 12*b*, 14*b*. The spacer member portions 18*a*, 18*b* may be integrally formed with the razor blade or may be fixedly joined thereto as by use of conventional adhesives. When preformed in this manner, the spacer member portions 18*a*, 18*b* may be provided with half the desired total thickness of the spacer, so that when the blades 12*b* and 14*b* are placed adjacently to each other within a safety razor, the total height or thickness of the resulting spacer member will be equal to the desired value.

Referring to FIG. 7, it should be evident that the spacer member 18 may assume a large range of dimensions with attendant large variations in the radii of curvature of the blades within the safety razor, as well as a large range of offset distances *d* between the cutting edges. However, it has been found that for optimum performance, the maximum width W of a spacer element 18 is 0.5 inches, and the maximum thickness T is 0.015 inches for spacer elements of the type and configuration shown in FIG. 1.

While the rectangular spacer 18 described above is particularly useful with respect to flexible double edge razor blades, insert elements having triangular or other cross-sections may be used with flexible or rigid razor blades to position or orient the cutting edges in the desired manner as described.

It is to be understood that the foregoing description of the various embodiments illustrated herein is exemplary and various modifications to the embodiments shown herein may be made without departing from the spirit and scope of the invention.

What is claimed is:

1. A razor blade arrangement comprising a first generally planar razor blade having a longitudinally extending cutting edge; a second generally planar razor blade identical to said first razor blade and having a longitudinally extending cutting edge; means including a spacer element adapted to be disposed between said razor blades, said means being configurated and dimensioned to bend both razor blades and offset the relative angular orientations of the planes of said cutting edges with respect to each other and to space said cutting edges from each other in directions substantially normal and parallel to the planes of said razor blades to place the cutting edges in extreme proximity to each other while maintaining the blade portions near the cutting edges in uniform pressure abutment immediately adjacent to the longitudinal cutting edges when said razor blades and said insert element are placed in a safety razor to form between said cutting edges a longitudinal space having a generally triangular cross-section, said insert element further maintaining said razor blades in generally parallel longitudinal relation during use.

2. A razor blade arrangement as defined in claim 1, wherein said razor blades each have a cut-out adapted to receive an alignment lug or positioning member of the safety razor, and wherein said insert element is provided with a cut-out generally similar in configuration to the cut-outs of said razor blades and in registry therewith when received in a safety razor.

3. A razor blade arrangement as defined in claim 1, wherein said razor blades are single edge blades.

4. A razor blade arrangement as defined in claim 2, wherein said razor blades are double edge blades, said spacer element similarly offsetting the proximate sets or pairs of cutting edges of said razor blades on each horizontal side of the safety razor.

5. A razor blade arrangement as defined in claim 1, wherein said spacer is generally rectangular and has a maximum width or transverse dimension of said spacer element is 0.5 inch.

6. A razor blade arrangement as defined in claim 1, wherein said spacer is generally rectangular and has a maximum thickness of said spacer element is 0.015 inch.

7. A razor blade arrangement as defined in claim 1, wherein said spacer element is integrally formed with at least one of said razor blades.

8. A razor blade arrangement as defined in claim 1, wherein said spacer element is fixedly joined to at least one of said razor blades.

9. A razor blade arrangement as defined in claim 1, wherein said first and second razor blades are similar and have the same dimensions.

10. A razor blade arrangement as defined in claim 1, wherein said insert element is rigid.

11. A razor blade arrangement as defined in claim 1, wherein said insert element is resilient.

12. In combination with a safety razor having a relatively fixed guard element and at least one arcuate bending or clamping place adjustably positionable with respect to said fixed guard element, a razor blade arrangement comprising a first generally planar razor blade having a longitudinally extending cutting edge; a second generally planar razor blade generally identical to said first razor blade and having a longitudinally extending cutting edge; and means including a spacer element adapted to be disposed between said razor blades, said means being configurated and dimensioned to curve both razor blades and offset the relative angular orientations of the planes of said cutting edges with respect to each other and to space said cutting edges from each other in directions substantially normal and parallel to the planes of said razor blades to place the cutting edges in extreme proximity to each other while maintaining the blade portions near the cutting edges in uniform pressure abutment immediately adjacent to the longitudinal cutting edges when said razor blades and said insert element are placed in a safety razor to form between said cutting edges a longitudinal space having a generally triangular cross-section, said insert element further maintaining said razor blades in generally parallel longitudinal relation during use, whereby clamping said razor blade arrangement between said guard element and said bending or clamping place causes said first razor blade proximate to said bending or clamping plate to assume a radius of curvature smaller than that of said second razor blade proximate to said guard to thereby offset the angular orientations as well as the transverse positions of said cutting edges.

13. A razor blade arrangement as defined in claim 1, wherein the two blades are in longitudinal abutment at the immediate beginning of the inward angle of the tapered cutting edges of said blades, creating an extremely small open longitudinal triangle whose walls leading to the longitudinal apex of said open triangle are the tapered inward sides of the upper and lower cutting edges which face each other.

* * * * *